US010603941B2

(12) United States Patent
Millman et al.

(10) Patent No.: US 10,603,941 B2
(45) Date of Patent: Mar. 31, 2020

(54) HIGH-QUALITY WOOD PRINTS AND METHODS OF MAKING THE SAME

(71) Applicant: Gallery Blocks LLC, Baltimore, MD (US)

(72) Inventors: Ryan J. Millman, Baltimore, MD (US); Cheyne Smith, Manchester, MD (US)

(73) Assignee: Gallery Blocks LLC, Hunt Valley, MD (US)

( * ) Notice: Subject to any disclaimer, the term of this patent is extended or adjusted under 35 U.S.C. 154(b) by 0 days.

(21) Appl. No.: 16/144,545

(22) Filed: Sep. 27, 2018

(65) Prior Publication Data

US 2019/0092063 A1 Mar. 28, 2019

Related U.S. Application Data

(60) Provisional application No. 62/564,026, filed on Sep. 27, 2017.

(51) Int. Cl.

| | |
|---|---|
| ***B41M 5/00*** | (2006.01) |
| ***B44C 5/04*** | (2006.01) |
| ***B44F 9/02*** | (2006.01) |
| *B41M 3/06* | (2006.01) |

(52) U.S. Cl.

CPC ..... *B41M 5/0076* (2013.01); *B41M 5/0047* (2013.01); *B44C 5/043* (2013.01); *B44C 5/0492* (2013.01); *B44F 9/02* (2013.01); *B41M 3/06* (2013.01)

(58) Field of Classification Search

CPC .... B41M 5/0047; B41M 5/0076; B41M 3/06; B44C 5/0492; E06B 3/825; E06B 3/7001

See application file for complete search history.

(56) References Cited

U.S. PATENT DOCUMENTS

| | | | | |
|---|---|---|---|---|
| 8,037,820 | B2 * | 10/2011 | Daniels | E06B 3/825 101/35 |
| 2003/0035917 | A1 * | 2/2003 | Hyman | B41M 1/30 428/67 |
| 2011/0236644 | A1 * | 9/2011 | Garitano | B41M 5/0011 428/195.1 |
| 2014/0274446 | A1 * | 9/2014 | Greaney | A63B 53/0466 473/307 |
| 2016/0296044 | A1 * | 10/2016 | Millman | A47G 1/0633 |

* cited by examiner

*Primary Examiner* — Anh T Vo

(74) *Attorney, Agent, or Firm* — Sterne, Kessler, Goldstein & Fox P.L.L.C.

(57) ABSTRACT

A method of making high-quality wood prints without the use of ultraviolet printing or dye sublimation printing is described herein. The methods provide for the application of an image area comprising a printed image to a wooden substrate to produce wall hangings, ornaments, plaques and the like that include high-resolution printed graphics with wood grains and textures visible for creating the aesthetic of high-quality wood prints. The invention allows for the production of high-quality wood prints in retail photo processing installations from graphics provided by customers, for example, on computer-readable media capable of being printed using standard technologies such as ink jet or laser jet printing. The invention provides a lower-cost alternative for consumers to obtain customized, high-quality wood prints and provides retailers with kits of materials necessary to meet consumer demand for the products described herein.

18 Claims, 17 Drawing Sheets

HIGH-QUALITY WOOD PRINTS AND METHODS OF MAKING THE SAME

CROSS-REFERENCE TO RELATED APPLICATIONS

This application claims benefit to U.S. Provisional Application 62/564,026, filed Sep. 27, 2017, the contents of which are hereby incorporated by reference in their entirety.

STATEMENT REGARDING FEDERALLY SPONSORED RESEARCH AND DEVELOPMENT

This invention was made without federal government support.

BACKGROUND OF THE INVENTION

Printing images on wood or wooden substrates (known in the art as a "wood prints") cannot presently be accomplished without significant equipment and expense. The equipment required includes expensive ultraviolet (UV) printing equipment to print directly on the wood, or heat press equipment for the pressing and transfer of images on paper to the wooden substrate through a sublimation printing process. The current process and machinery are neither cost-effective nor efficient because the require significant floor space, operator training and maintenance, making it undesirable to retail image and photo processing installations to produce high-quality wood prints for their customers, despite the high demand for these products.

There is a specific demand among these customers for high-quality wood prints that can be prepared from an image file provided to retail image and photo processing installations on site, for example, on a universal serial bus (USB) drive or other computer-readable memory device that can be accessed by in-store computer processors for editing and production of tangible image displays such as photographs and copies. Many customers enjoy the aesthetic of the wood grain as visual or textural background to their images of choice, an aesthetic that cannot be achieved through printing on non-wooden substrates. The present invention provides a method for producing high-quality wood prints on wooden materials of multiple sizes and dimensions using existing ink jet or laser jet printing equipment, for example, without the investment in equipment and training associated with the existing methods of creating these wood prints using UV or sublimation printing technologies.

BRIEF SUMMARY OF THE INVENTION

The present invention eliminates the need for expensive machinery and provides a method for creating a wood print using a relatively standard, inexpensive laser or inkjet printer to print an image on a substrate consisting of a thin sheet of material that can be adhered to a wooden substrate (an "image sheet") to produce a high-quality wood print. In certain embodiments, the image sheet comprises a perforated border around the area containing the printed image (the "image area"). In one embodiment, the image area is created by printing an image therein on an image side of a perforated sheet of material, wherein the perforations define a border around all or a portion of the image. In another embodiment, perforations in the image sheet may be made to define an image area within the image sheet after the image is printed thereon. In either embodiment, the image area is adhered to the wooden substrate and the perforated border is detached from the image area, resulting in a high-quality wood print. In a preferred embodiment, the woodgrain of the wood print is visible as background to the image.

DETAILED DESCRIPTION OF THE INVENTION

Figure 1A:
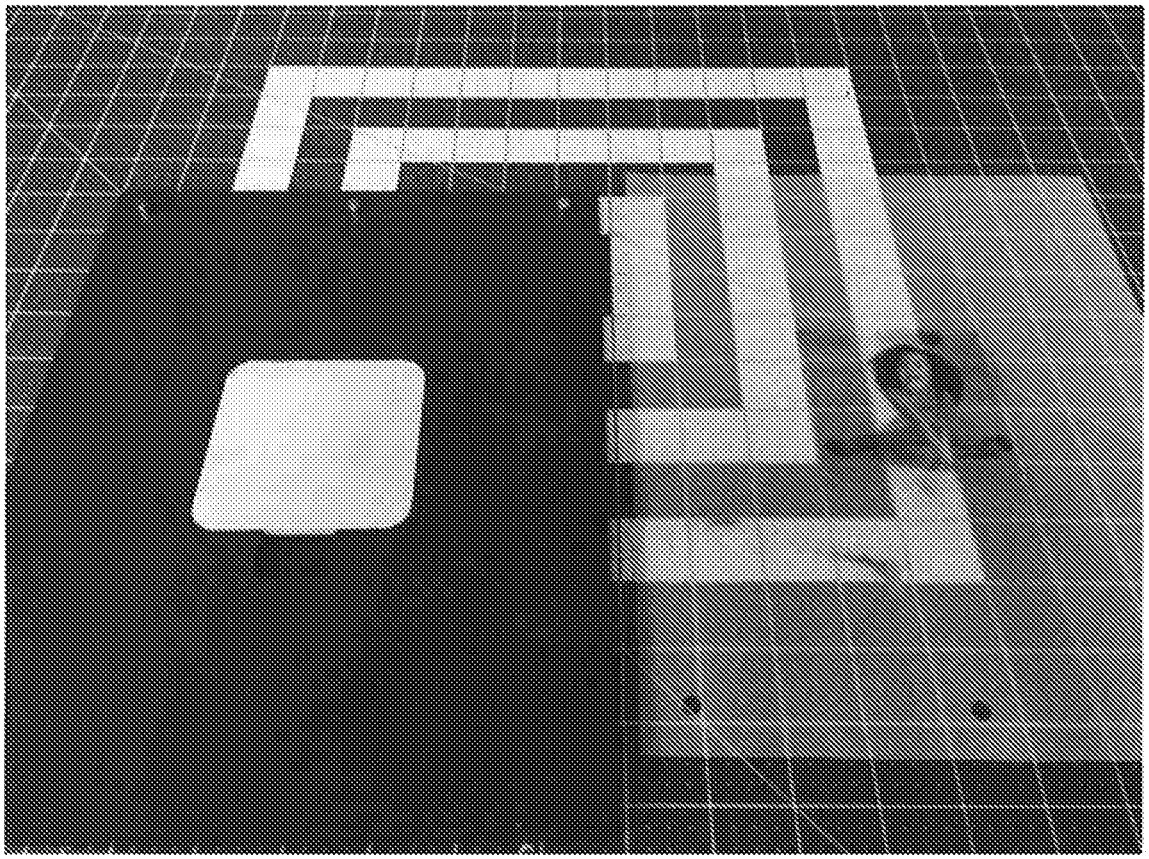
FIG. 1A shows an overview of features of the invention, including a substrate, perforated image sheet including an image area, assembly components, and alignment jig.
Figure 1B:
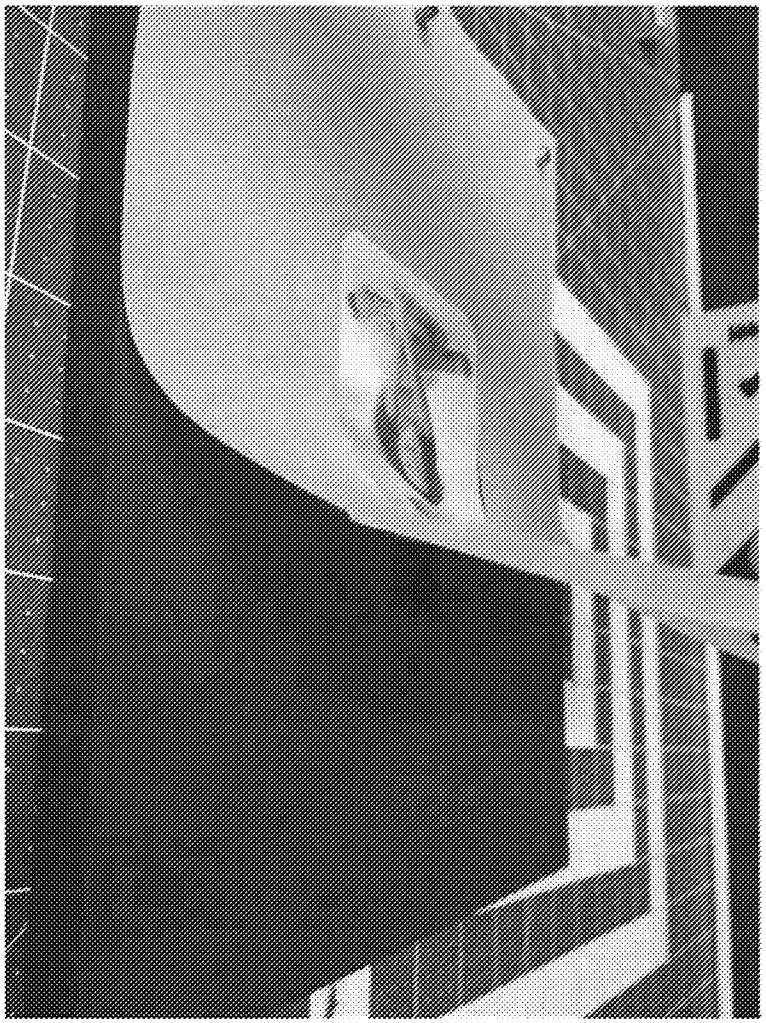
FIG. 1B shows the application of a perforated image sheet with image area to a substrate.
Figure 1C:
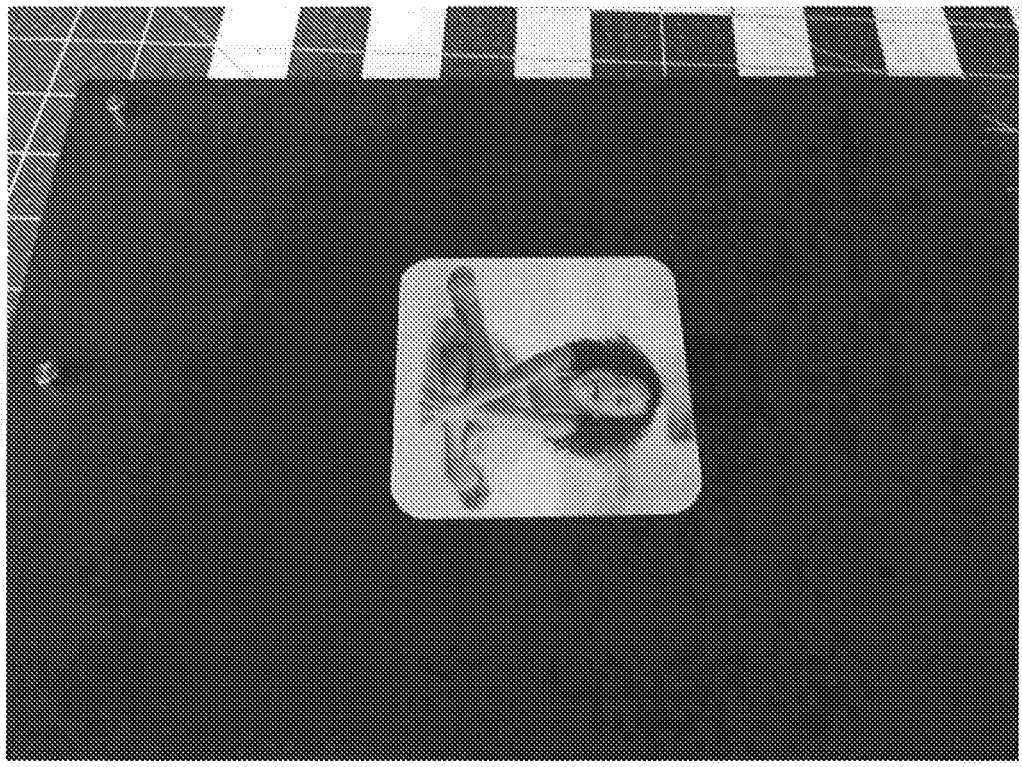
FIG. 1C shows an image area adhered to a substrate after aligning the image sheet on the substrate in a desired position and releasing the image area from the perforated image sheet.
Figure 1D:
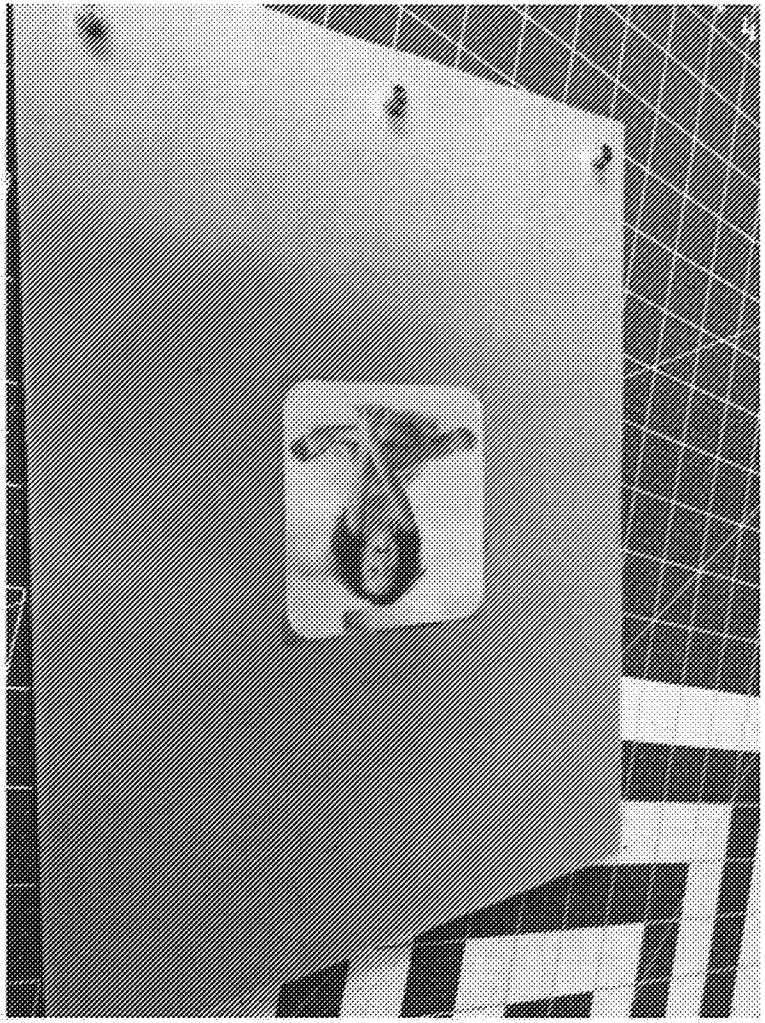
FIG. 1D shows an image sheet adhered to a substrate, wherein the image area is translucent or semi-translucent and visual characteristics of the substrate are seen beneath the image area.
Figure 1E:
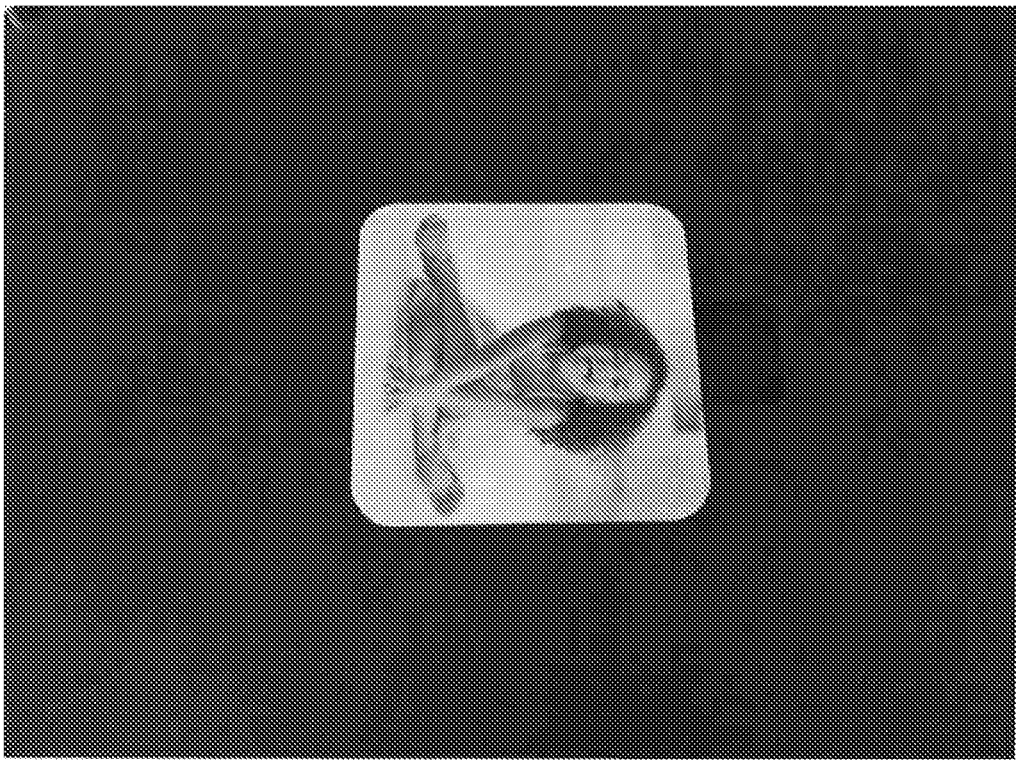
FIG. 1E shows a view of the image area adhered to the substrate after the image sheet has been detached at the perforations.
Figure 1F:
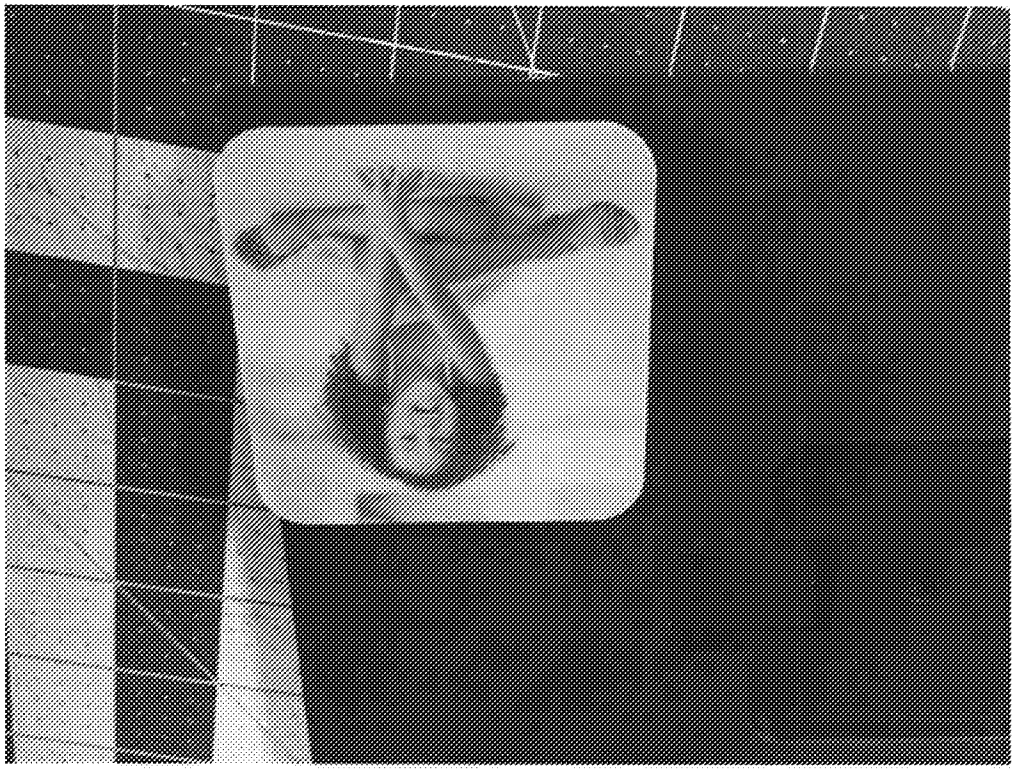
FIG. 1F shows an image area partially adhered to a substrate.
Figure 1G:
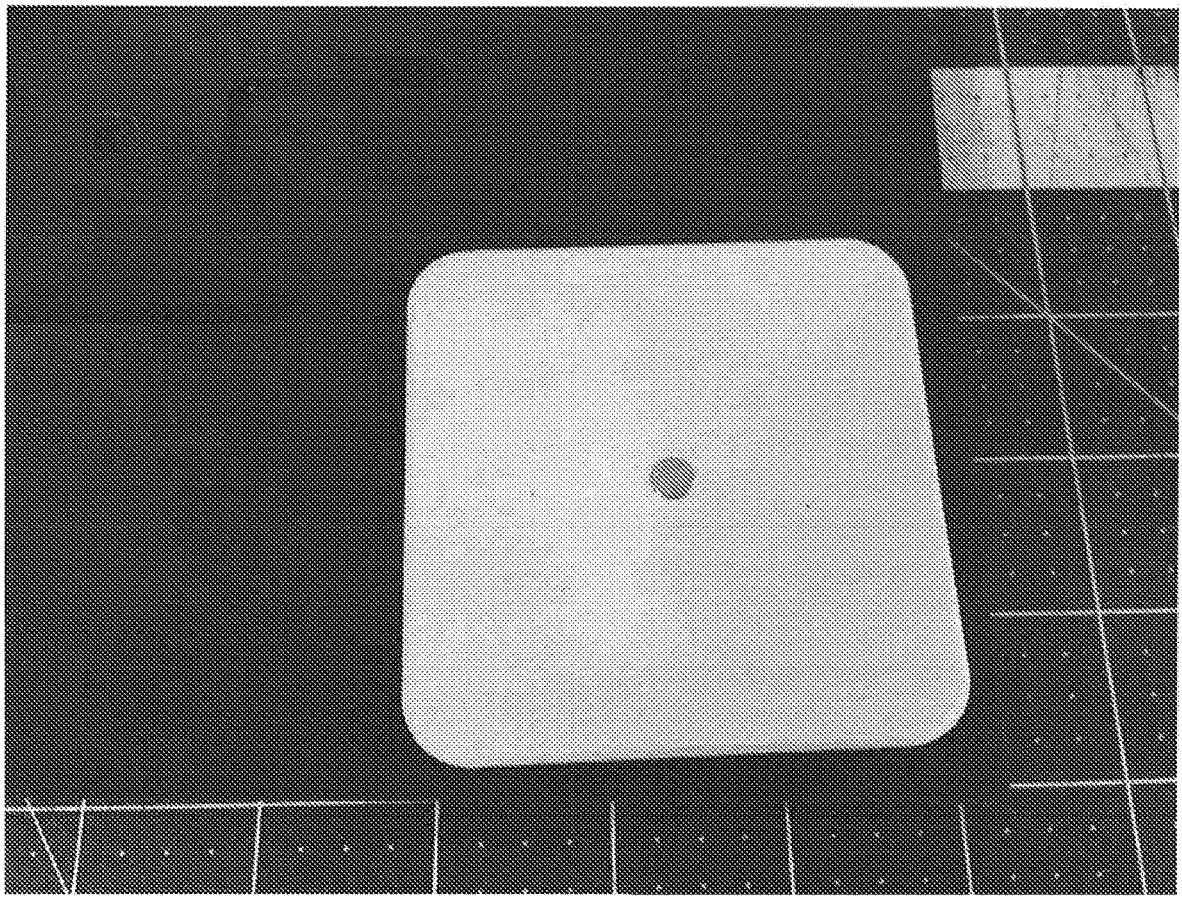
FIG. 1G shows a securing attachment means or handing means to substrate, for example, a magnetic attachment member, although other fasteners, attachment members or hanging means are envisioned and covered within the scope of this disclosure.
Figure 2A:
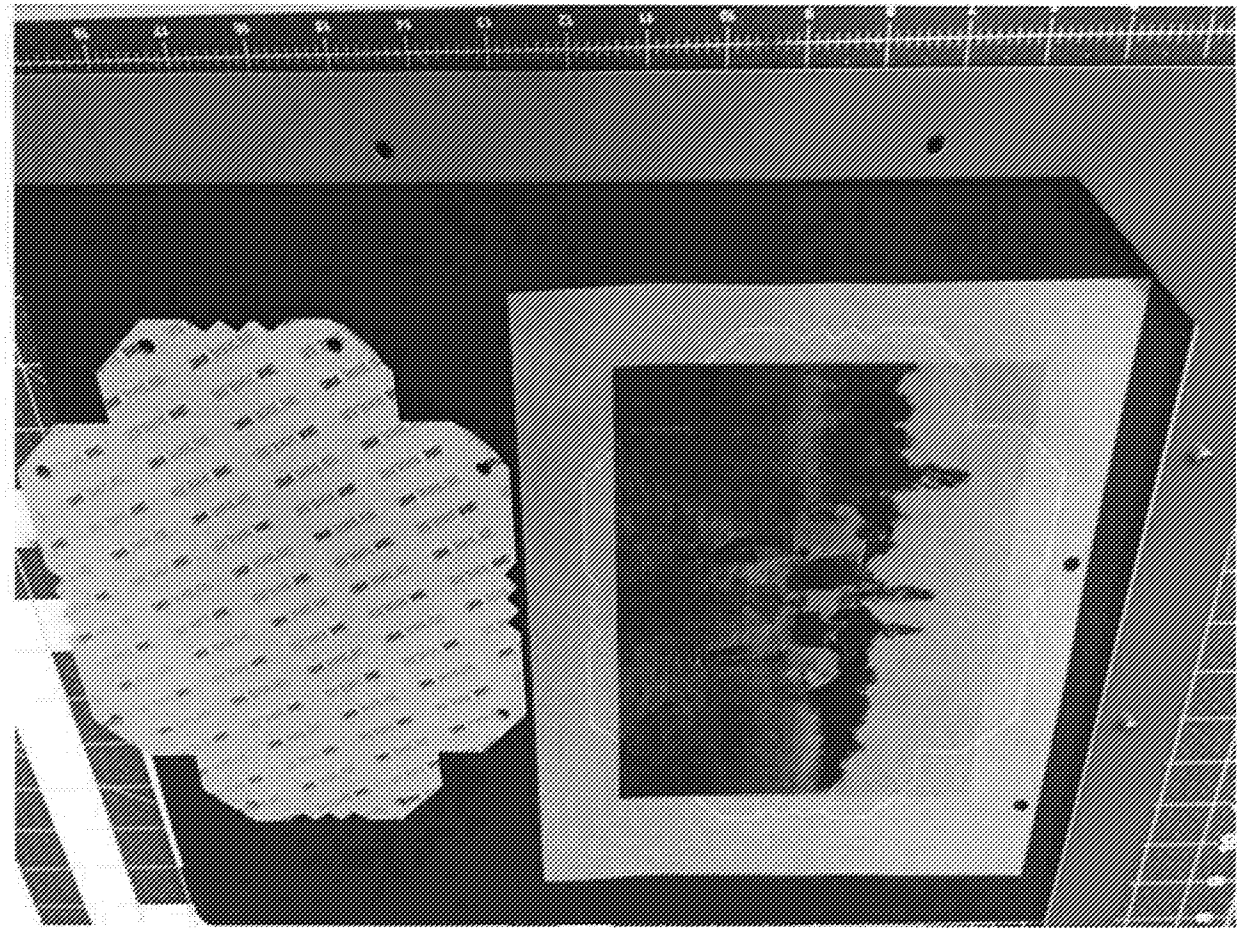
FIG. 2A shows an embodiment of the invention, including a substrate, perforated image sheet, assembly components and alignment jig.
Figure 2B:
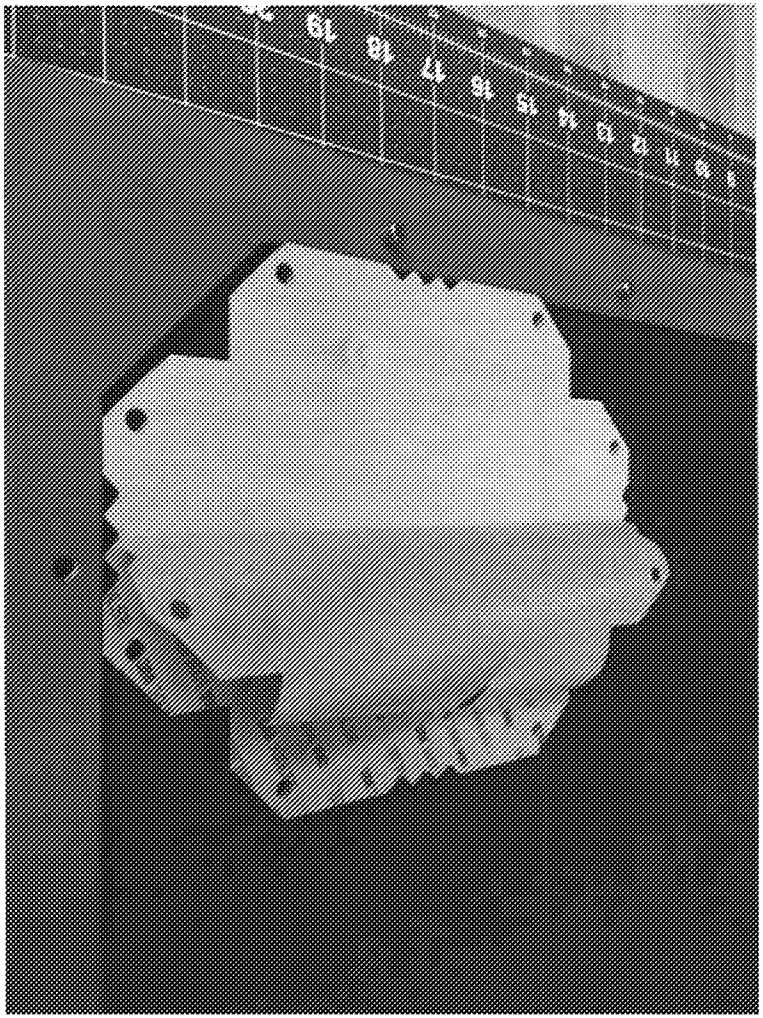
FIG. 2B shows a substrate comprising an adhesive layer, configured with peripheral edges, cut outs, or other alterations and modifications to allow the substrate to assembled from a planar (unassembled) form to a secondary (assembled) display assembly, for example, a segmented substrate formed by applying v-grooves along the surface of the substrate opposite to the side to which the image area is adhered, so that the substrate may be folded along the v-grooves to form an assembled image display.
Figure 2C:
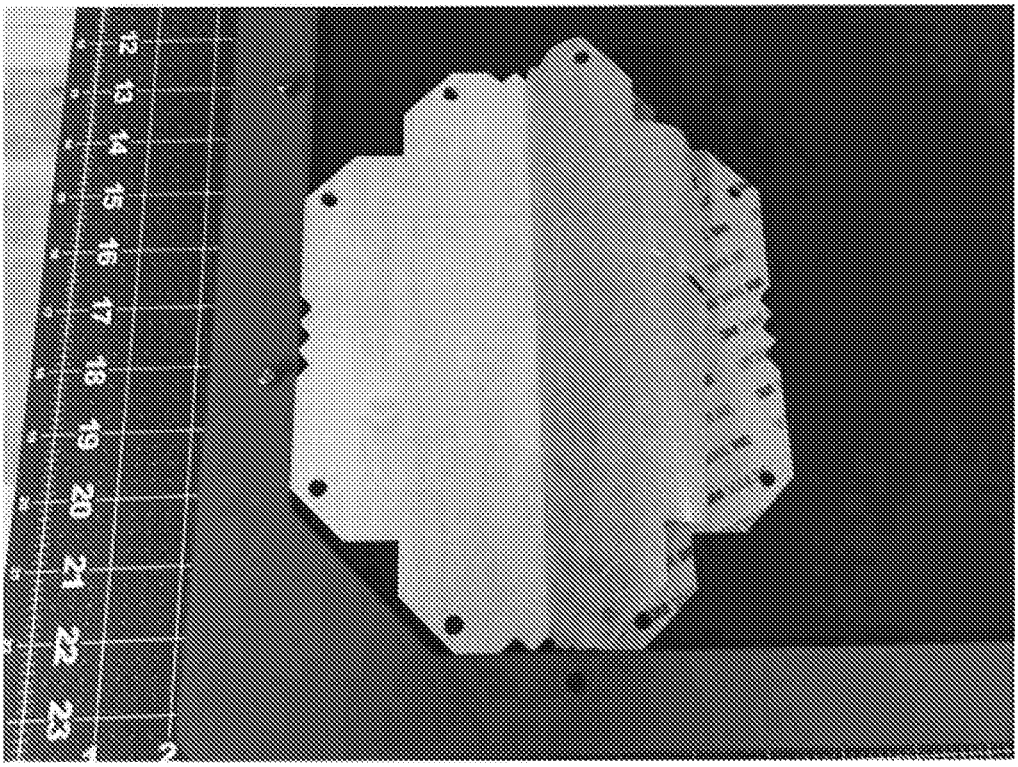
FIG. 2C shows a slightly different view of FIG. 2B, with a protective layer being removed to expose the adhesive layer.
Figure 2D:
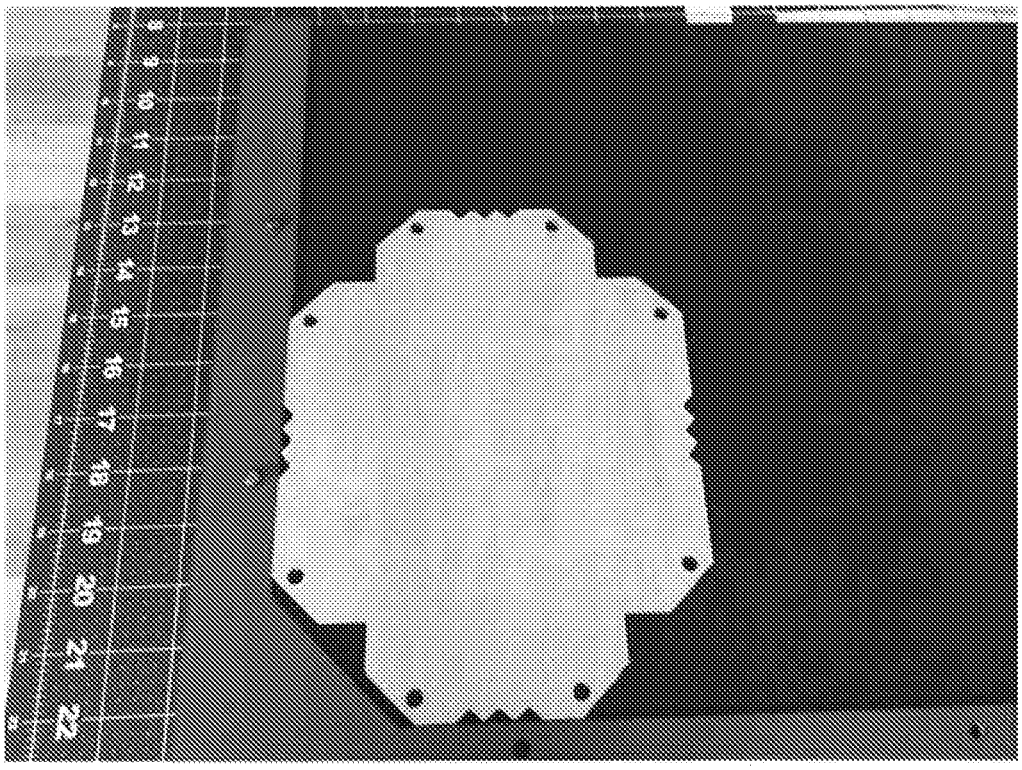
FIG. 2D shows the substrate as shown in FIGS. 2B and 2C, with a provided protective layer removed to expose the adhesive surface of the substrate for attachment of an image area.
Figure 2E:
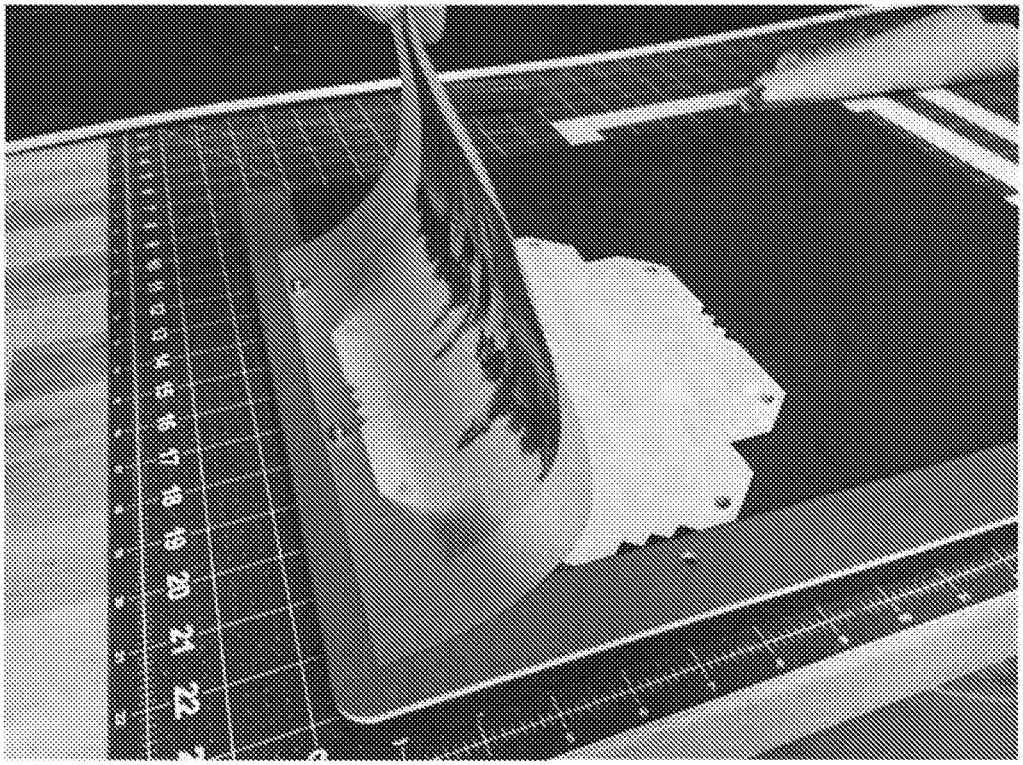
FIG. 2E shows the alignment and application of an image sheet comprising an image area to a substrate as depicted in FIG. 2D.
Figure 2F:
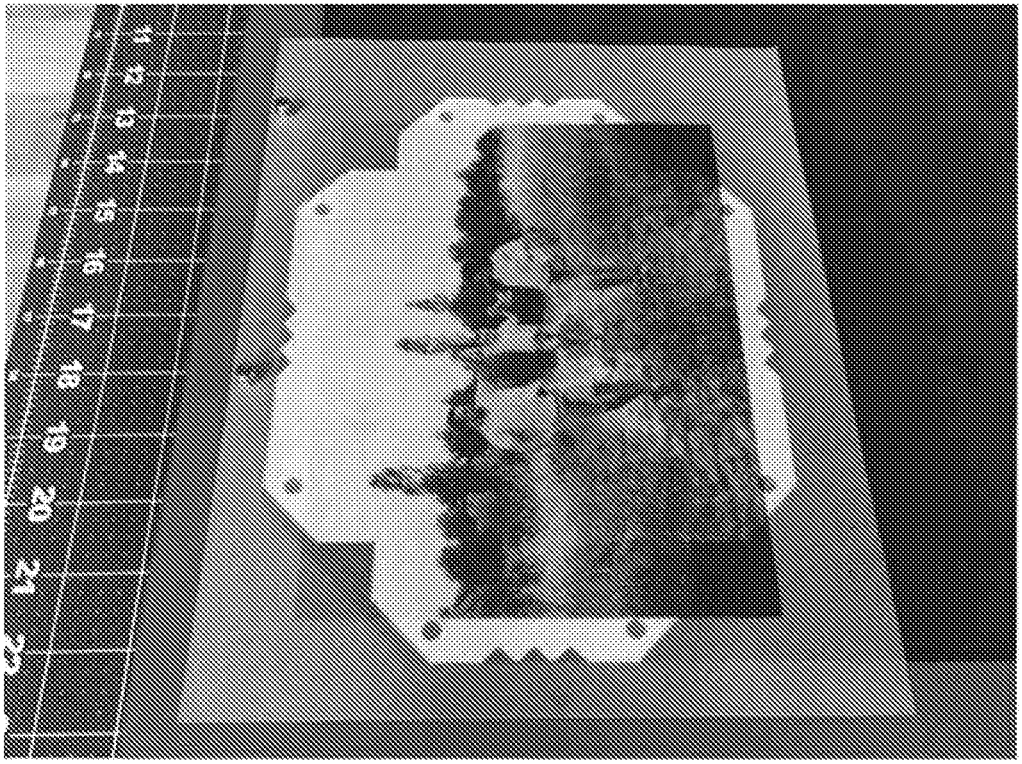
FIG. 2F shows further application of the image sheet as shown in FIG. 2E, wherein the image area of the image sheet is applied in part to the substrate.
Figure 2G:
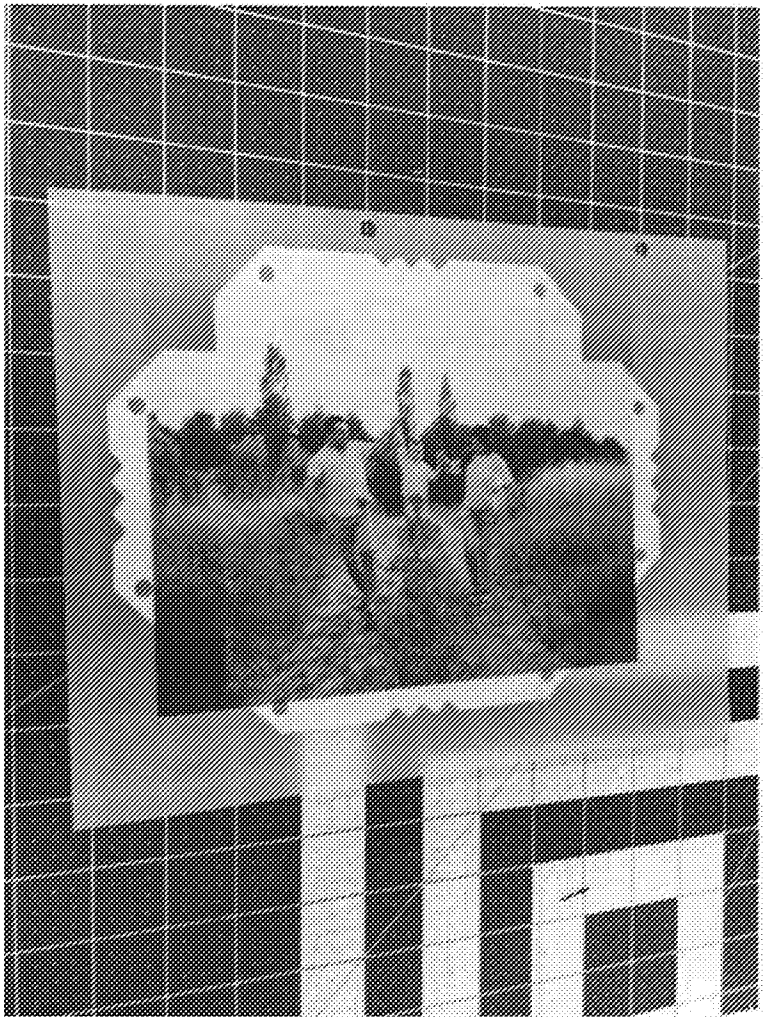
FIG. 2G shows the image sheet and image area as applied to the substrate in FIG. 2F with attachment means removed from the periphery of the image sheet.
Figure 2H:
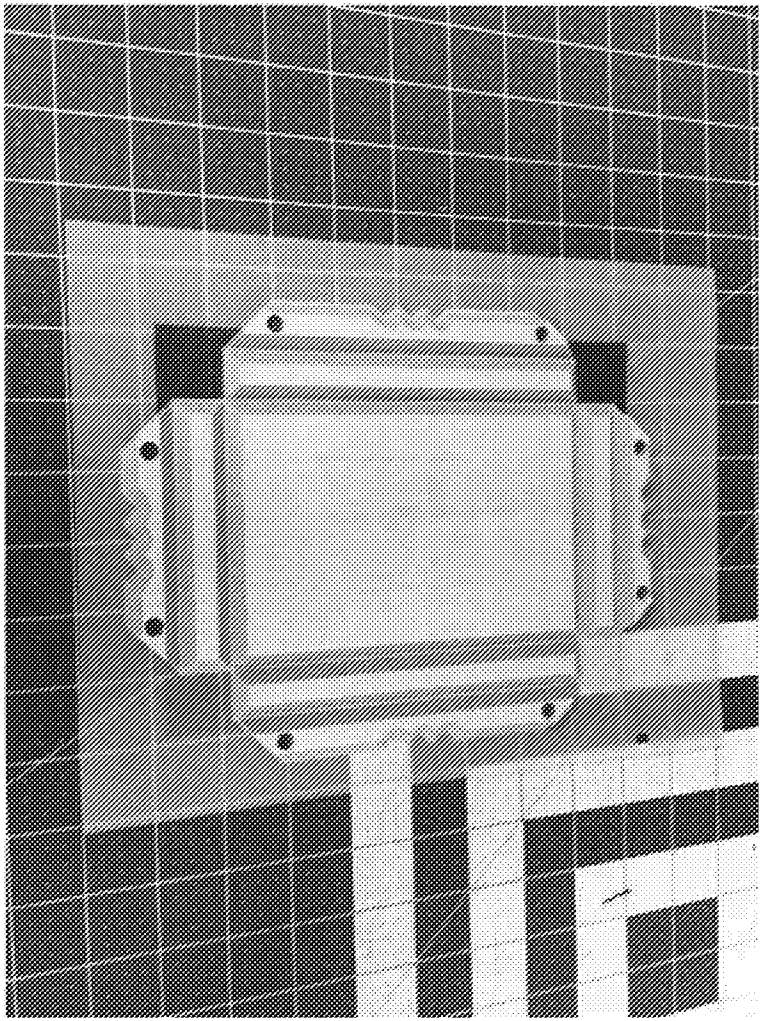
FIG. 2H shows the surface of the substrate opposite the surface to which the image area is applied (the "non-image face") with peripheral edges of the substrate modified to include scalloped edges or cut-outs along a portion of the peripheral edge in order to provide hanging means along a non-image face of the assembled structure.
Figure 2I:
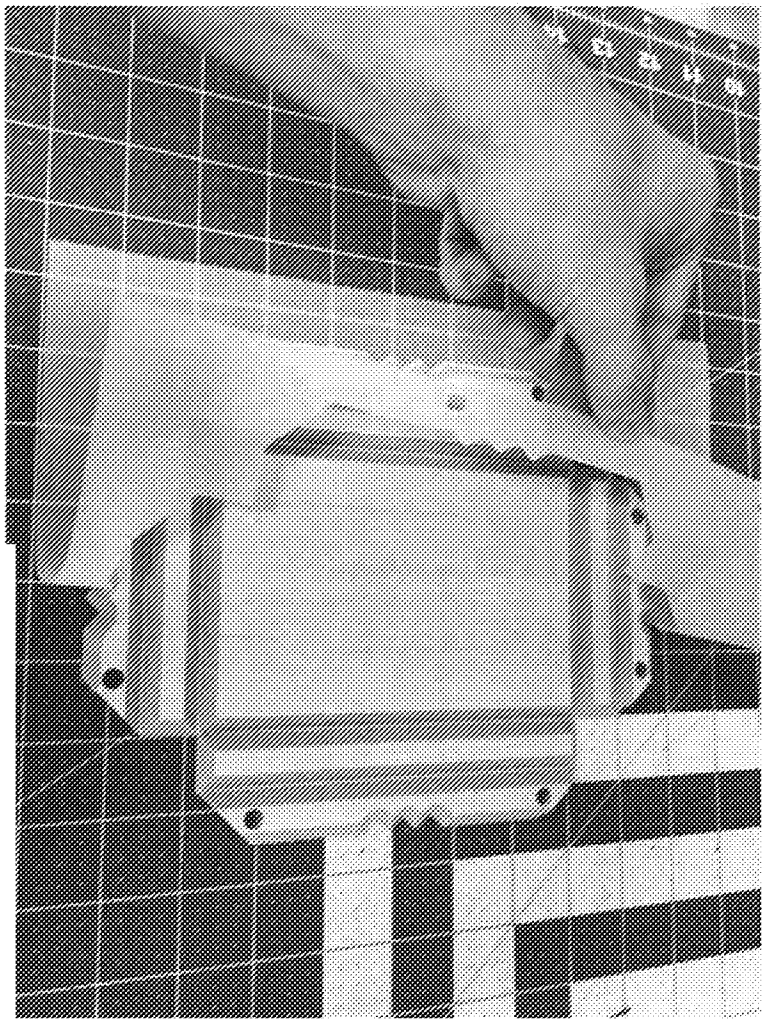
FIG. 2I shows the method step of removing the image sheet from the substrate along perforations applied to the image sheet prior to application to the substrate.
Figure 2J:
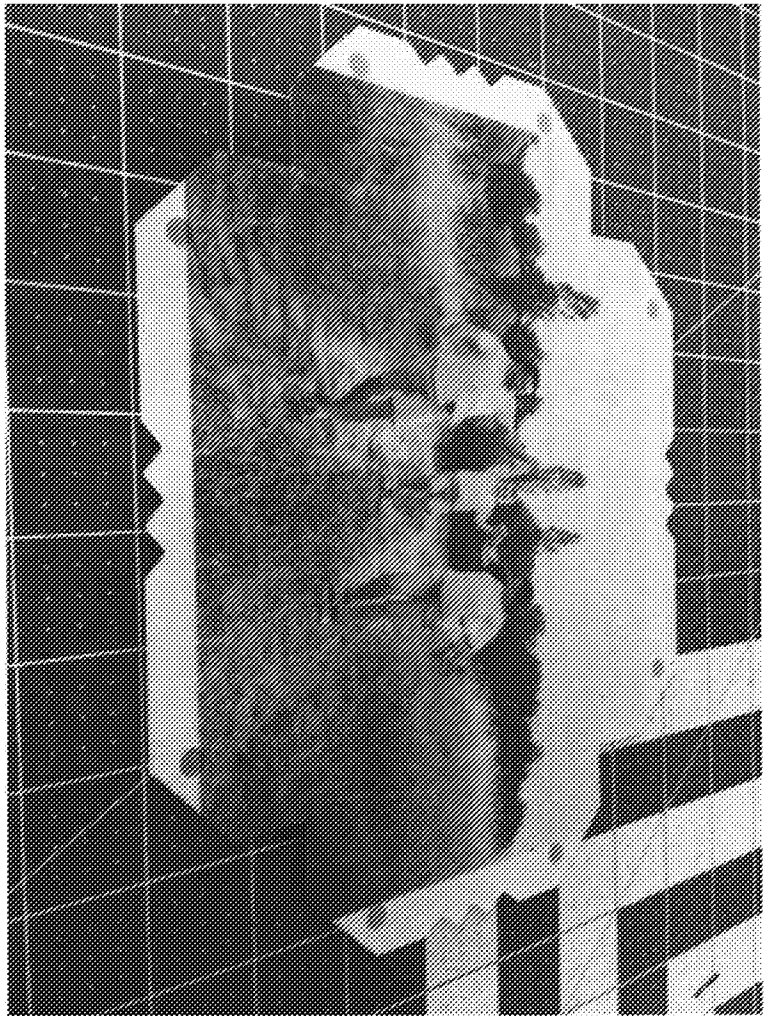
FIG. 2J shows a substrate in unassembled for with an image area applied, wherein the peripheral edges may be folded in order to create image sides comprising the outer periphery of the image area as well as an additional scalloped substrate surface that faces away from the image face and allows for hanging of the assembled form of the image display, for example, on a wall or other vertical surface.

The invention is that of what are known in the art as a high-quality wood prints and methods of making the same. The invention improves upon that which is known in the art by allowing for the production of high-quality wood prints without the need for specialized printing equipment or a chemical image transfer process such as sublimation, which one of ordinary skill in the art will recognize as being state of the art in the production of wood prints. The invention provides for the application of a high-resolution (up to 4800×1200 dpi image sheet containing a printed image to a wooden substrate such as treated or untreated wood, reclaimed wood, recycled wood, particle board, or other wood-based materials, including veneers or medium density fiberboard (MDF), and all including any necessary natural or synthetic resins or other suitable binders that impart rigidity and strength to the substrate.

In a preferred embodiment, a wooden image display is produced such that the natural woodgrain is visible through the image without using the conventional methods of ultraviolet (UV) printing or sublimation, which are the only methods known in the art for the production of high-quality wood prints. One of ordinary skill in the art will appreciate that various textures and contours of the wooden substrates described herein are useful in creating aesthetics that cannot be achieved by imaged displays applied to non-wooden substrates.

To produce wood prints of comparable quality to that of the present invention currently using UV printing, UV-curable ink is printed directly to a wooden substrate and cured by the application of UV light to the ink. This requires a large format flatbed printer that typically retails for over $70,000 and can only be operated by users who have had extensive training on its operation and safe use. The equipment and maintenance costs and training requirements associated with use of UV printers have made it cost-prohibitive for retail photo processing installations to be able to produce high-quality wood prints for customers. The present invention offers a solution to this problem.

Wood prints have also been created in the past using a chemical process known as dye sublimation. To transfer an image using this technique, a wooden substrate, with or without a coating to facilitate receipt of the dye by the substrate, is exposed to an image sheet including an image area created using a dye sublimation printer. The image sheet is placed over the wooden substrate in order to allow transfer of the image area to the wooden substrate using a heat press. Like UV printers, dye sublimation printers can be expensive and large, making them ill-suited for installation in retail photo outlets where customers would like to purchase wood prints. As such there exists a long-felt need in the art for the technology of the present invention.

In one embodiment, a wooden substrate suitable for use with the methods of manufacture described herein may have a thickness ranging from 0.0625 inches and to 0.5 inches, inclusive, and from 0.03 inches up to 2.5 inches, inclusive, although thickness is variable depending on the materials of the substrate and may be expressed as suitable thickness in metric units.

In certain embodiments, the substrate may be configured with notches, grooves and or cut-outs to allow the substrate to be folded or assembled into a three-dimensional structure from an unassembled form. The three-dimensional structure may be selected from the group consisting of cubes, cuboids, pyramids, cones and cylinders for example, or variants thereof. In another embodiment, the substrate is configured with hanging or attachment means such as for displaying the assembled structure.

In another aspect of the invention, an image sheet with an image printed thereon comprises perforations defining an image area including some or all of the printed image. In certain preferred embodiments, the perimeter of the image area defined by the perforations corresponds to a perimeter of at least a portion of the substrate. This enables the transfer of the image area defined by the perimeter to the substrate by adhesion of the image sheet or adsorption of the ink or toner used to create the printed image contained within the image area to the substrate.

In one aspect a roll or sheet material is run through a die-cutting machine or computer numerical control (CNC) cutting table to make a perforated sheet. The perforated sheets can be run through different printing devices including laser printers and inkjet printers. In another example, the print can be punched out after printing and then applied to substrate. In preferred embodiments, the selected printers are used to print an image on the perforated sheets, thereby creating an image area partially or wholly within the perforations that may be transferred to the substrate by multiple selected means.

In one embodiment, the image sheet comprises one or more of an image area defined by a perforated perimeter. The image may be separated from the sheet by releasing the perforations, and the resulting printed image may then be affixed to the substrate; alternatively, the sheet may be affixed to the substrate and the remaining image sheet separated from the affixed image by release of perforations.

Examples of materials from which an image sheet may be fabricated include paper, including translucent or transparent paper, vellum, transparency film, translucent or transparent vinyl or other natural or synthetic materials on which a permanent image may be printed, including by ink jet or laser printing. Perforations comprise, for example, punched, holes, slots, decorative shapes, and may be applied prior to or after the printing of an image on the image sheet.

In one embodiment, the substrate comprises an adhesive to which the image sheet may be adhered. The adhesive may be overlaid with a removable liner such that the substrate may be placed into an alignment jig where the adhesive liner is removed, exposing the adhesive and allowing the image sheet to be aligned to the jig using pin registrations with the holes cut into the image sheet and adhered to the substrate. One of ordinary skill in the art will appreciate that multiple equivalent alignment means may exist and be useful for carrying out the manufacture of the high-quality wood prints described herein.

In another embodiment, images are affixed to the substrate by means of neodymium rare earth magnets or a magnetic sheet can be used or a magnetic material or magnetic layer can be applied to the image or image sheet. In another embodiment, an adhesive transfer tap is applied to the base substrate or image sheet to make the adhesive bond between the substrate and the image sheet.

The invention includes a kit of parts, comprising a perforated image sheet and a substrate for assembly of an image display. A method of creating an image display assembly is also provided, comprising: affixing at least one image sheet comprising an image area bordered by perforations to a wooden substrate. A method of assembling a perforated image sheet, an image substrate, and an assembled image display are also provided.

It will be clear to a person skilled in the art that features described in relation to any of the embodiments, aspects or examples described herein can be applicable interchangeably between the different embodiments. The embodiments described above are examples to illustrate various features of the invention, and they are not exhaustive or exclusive. Throughout the words "comprise" and "contain" and variations of them mean "including but not limited to", and they are not intended to (and do not) exclude other additives, components, materials or steps. Throughout, the singular encompasses the plural unless the context otherwise requires. In particular, where the indefinite article is used, the specification is to be understood as contemplating plurality as well as singularity, unless the context requires otherwise.

Features, materials, and characteristics, described in conjunction with a particular aspect, embodiment or example of the invention are to be understood to be applicable to any other aspect, embodiment or example described herein unless incompatible therewith. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. A method of making a wood print comprising:

aligning an image sheet having a printed image with a wooden substrate using an alignment jig, the image sheet comprises a perforated boarder around an image area;

applying the printed image to the wooden substrate.

2. The method of claim 1, wherein the wooden substrate is recycled wood.

3. The method of claim 1, wherein the image sheet is translucent.

4. The method of claim 1, wherein a laser printer or inkjet printer prints the printed image on the image sheet.

5. The method of claim 1, further comprising, applying an adhesive to the wooden substrate, wherein the adhesive is configured to couple the image sheet to the wooden substrate.

6. The method of claim 1, wherein the wooden substrate further comprises v-grooves in a non-image face of the wooden substrate, and wherein the wooden substrate is configured to fold at the v-grooves to form an assembled image display.

7. The method of claim 1, wherein the recycled wood is formed without resins.

8. The method of claim 1, wherein image sheet is larger than the image area.

9. The method of claim 8, further comprising the step of separating the image area from the image sheet at the perforated boarder.

10. The method of claim 1, further comprising the step of applying an adhesive to the wooden substrate before aligning the image sheet.

11. The method of claim 10, wherein the adhesive is on an adhesive substrate, and wherein the adhesive substrate has a removable liner that exposes an adhesive.

12. The method of claim 1, wherein the alignment jig comprises pins configured to engage holes cut into the image sheet.

13. The method of claim 12, wherein the holes cut into the image sheet are cut outside an image area of the image sheet.

14. The method of claim 13, wherein a perforation separates the holes from the image area.

15. A method of making a wood print comprising:

printing an image on an image area of an image sheet;

separating the image area from the image sheet at perforations formed in the image sheet;

aligning the image area with a wooden substrate using an alignment jig; and applying the printed image to the wooden substrate.

16. The method of claim 15, wherein alignment jig has an attachment means.

17. The method of claim 16, wherein the attachment means is a magnet.

18. The method of claim 17, wherein the magnet is a magnetic sheet.

* * * * *